US008823591B2

(12) United States Patent
Ying

(10) Patent No.: US 8,823,591 B2
(45) Date of Patent: Sep. 2, 2014

(54) ANTENNA ARRANGEMENT

(75) Inventor: Zhinong Ying, Lund (SE)

(73) Assignees: Sony Corporation, Tokyo (JP); Sony Mobile Communications AB, Lund (SE)

( * ) Notice: Subject to any disclaimer, the term of this patent is extended or adjusted under 35 U.S.C. 154(b) by 226 days.

(21) Appl. No.: 13/438,885

(22) Filed: Apr. 4, 2012

(65) Prior Publication Data

US 2012/0280883 A1 Nov. 8, 2012

Related U.S. Application Data

(60) Provisional application No. 61/482,228, filed on May 4, 2011.

(30) Foreign Application Priority Data

May 4, 2011 (EP) ..... 11164710

(51) Int. Cl.
*H01Q 1/24* (2006.01)

(52) U.S. Cl.
USPC ..... 343/702; 343/700 MS; 343/846

(58) Field of Classification Search
USPC ..... 343/702, 700 MS, 846
See application file for complete search history.

(56) References Cited

U.S. PATENT DOCUMENTS 7,825,863 B2 * 11/2010 Martiskainen et al. ..... 343/702
2004/0212545 A1 10/2004 Li et al.
2008/0266190 A1 10/2008 Ohba et al.
2009/0189815 A1 7/2009 Hotta et al.
2011/0032165 A1 2/2011 Heng et al.

FOREIGN PATENT DOCUMENTS

WO 2005/069439 A1 7/2005
WO 2008/059509 A2 5/2008

OTHER PUBLICATIONS

European Search Report dated Aug. 29, 2011 issued in corresponding EP application No. 11164710.3, 15 pages.

* cited by examiner

*Primary Examiner* — Hoang V Nguyen

(74) *Attorney, Agent, or Firm* — Snyder, Clark, Lesch & Chung, LLP

(57) ABSTRACT

The embodiments herein relate to an antenna arrangement comprising a ground element, and a first branch comprising a first inductor loading (L1) and a second inductor loading (L2). The antenna arrangement further comprises a second branch connected to the ground element via a feeding point, a third branch comprising a third inductor loading (L3) and a first grounding pin connected to the first branch. A first conductor loading (C1) is arranged between the first branch and the second branch. A second conductor loading (C2) is arranged between the second branch and the third branch. And the second branch is connected to the first branch via the first conductor loading (C1) and the second branch is connected to the third branch via the second conductor loading (C2).

10 Claims, 3 Drawing Sheets

ANTENNA ARRANGEMENT

RELATED APPLICATIONS

This application claims priority under 35 U.S.C. §119 based on U.S. Provisional Patent Application No. 61/482,228 filed May 4, 2011 and European Patent Application No. 11164710.3, filed May 4, 2011, the disclosures of which are both hereby incorporated herein by reference.

TECHNICAL FIELD

Embodiments herein relate generally to an antenna arrangement and an electronic device comprising the antenna arrangement.

More particularly the embodiments herein relate to a LC loading wideband antenna for cellular and non-cellular radio frequency bands.

BACKGROUND

In a typical wireless communications network, a mobile terminal, also known as mobile station, wireless terminal and/or User Equipment unit (UE), communicates via a Radio Access Network (RAN) to a Core Network. The radio access network covers a geographical area, which is divided into cell areas, with each cell area being served by a base station, e.g., a Radio Base Station (RBS). A cell is a geographical area where radio coverage is provided by the radio base station at a base station site. Each cell is identified by an identity within the local radio area, which is broadcast in the cell, and each cell is assigned multiple frequencies. The base stations communicate over the air interface operating on radio frequencies with the mobile terminals within range of the base stations. In other words, radio waves are used to transfer signals between the base station and the mobile terminal. In some cases, a communications network divided into cells may be called cellular systems and the frequencies may be called cellular frequencies.

A mobile terminal comprises an antenna connected to a chassis. The mobile terminals may be mobile stations, user equipments, mobile telephones also known as cellular telephones, laptops with wireless capability. The mobile terminals may also be portable, pocket, hand-held, computer-included, or car-mounted mobile devices, which communicate voice and/or data with a radio access network. The antenna is a necessary feature of the mobile terminal in order to transmit and receive radio signals from e.g., base stations and/or other mobile terminals. A challenge for manufacturers of mobile terminals, chassis and antennas is the interrelationship between cost, size, efficiency and bandwidth.

Coming future mobile terminals need to cover both multi-band and multi-system. Multi-band refers to a device supporting multiple radio frequencies used for communication. A frequency band may be cellular or non-cellular. Examples of cellular bands may be e.g., 700-800 megahertz (MHz), 824-894 MHz, 880-960 MHz, 1710-1850 MHz, 1820-1990 MHz, 1920-2170 MHz, 2300, 2400 and 2500-2700 MHz. In addition, there are non-cellular bands such as Global Positioning System (GPS), Wireless Fidelity (WiFi), Worldwide Interoperability for Microwave Access (Wimax) bands to be covered. Also the antenna has to be compact, less sensitive to user hand and head.

An LC circuit, also called a resonant circuit or tuned circuit, comprises an inductor, represented by the letter L, and a capacitor, represented by the letter C. When connected together, they can act as an electrical resonator storing electrical energy oscillating at the circuit's resonant frequency.

SUMMARY

The objective of embodiments herein is therefore to obviate at least one of the above disadvantages and to provide and improved antenna arrangement.

According to a first aspect, the objective is achieved by an antenna arrangement. The antenna arrangement comprises a ground element and a first branch comprising a first inductor loading and a second inductor loading. The antenna arrangement further comprises a second branch connected to the ground element via a feeding point. The antenna arrangement further comprises a third branch comprising a third inductor loading, and a first grounding pin connected to the first branch. A first conductor loading is arranged between the first branch and the second branch. A second conductor loading is arranged between the second branch and the third branch. The second branch is connected to the first branch via the first conductor loading and the second branch is connected to the third branch via the second conductor loading.

According to a second aspect, the objective is achieved by an electronic device comprising the antenna arrangement.

Embodiments herein afford many advantages, of which a non-exhaustive list of examples follows:

An advantage of the embodiments herein is that they provide an easy and cost-effective implementation and production of the antenna arrangement. The antenna arrangement of the embodiments herein is compact, and has a high tolerance for physical contact made by a users hand and/or head using the antenna arrangement. Another advantage is that the embodiments herein cover both multi-band and multi-systems.

The embodiments herein are not limited to the features and advantages mentioned above. A person skilled in the art will recognize additional features and advantages upon reading the following detailed description.

BRIEF DESCRIPTION OF THE DRAWINGS

The embodiments herein will now be further described in more detail in the following detailed description by reference to the appended drawings illustrating the embodiments and in which.

The drawings are not necessarily to scale and the dimensions of certain features may have been exaggerated for the sake of clarity. Emphasis is instead placed upon illustrating the principle of the embodiments herein.

DETAILED DESCRIPTION

Figure 1:
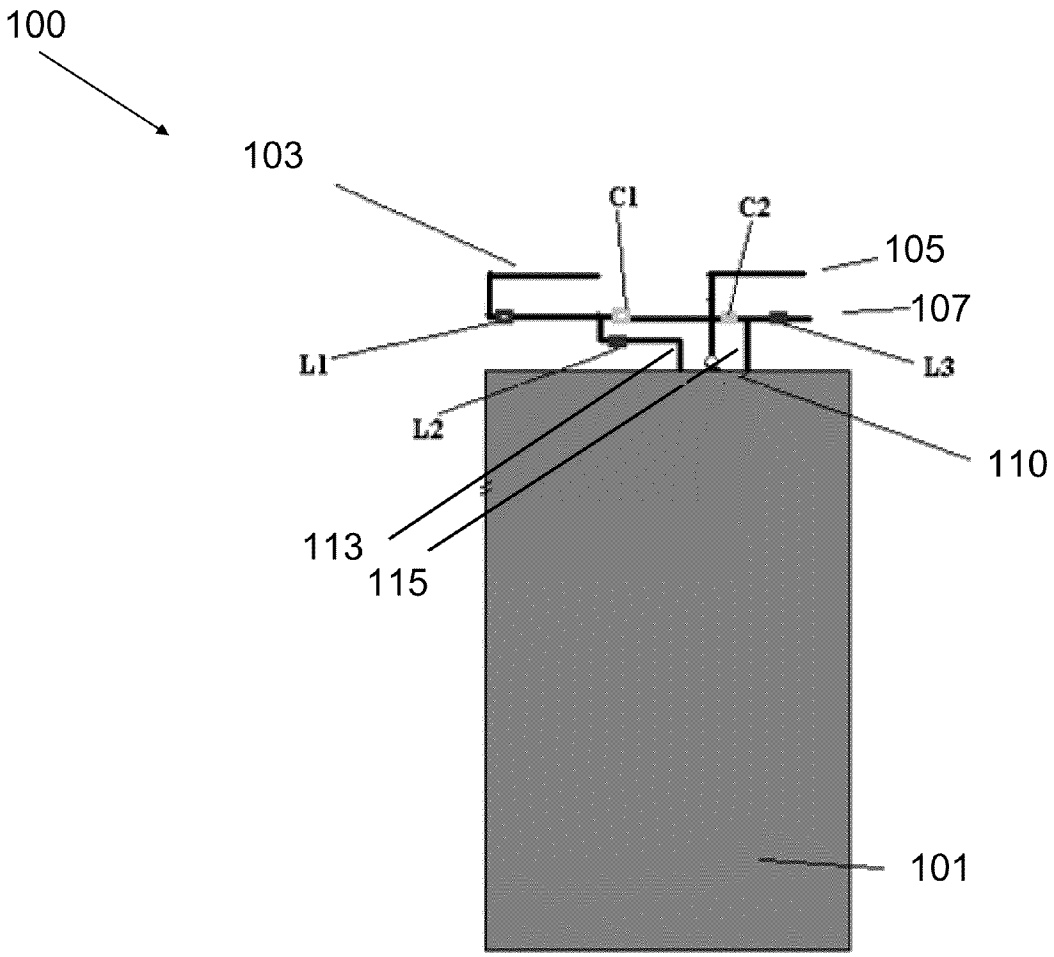
FIG. 1 is a block diagram illustrating embodiments of an antenna arrangement.

FIG. 1 is a schematic block diagram illustrating embodiments of an antenna arrangement 100. The antenna arrangement 100 is an LC-loading antenna arrangement. The antenna arrangement 100 comprises a ground element 101. The ground element 101 is an electrically conductive surface arranged to provide a relationship between the antenna arrangement 100 and another object. The ground element 101 may be a Printed Wiring Board, referred to as PWB, a flex film or printed on a three dimensional plastic carrier.

The antenna arrangement 100 further comprises a first branch 103, a second branch 105 and a third branch 107. The first branch 103 comprises a first inductor loading L1 and a second inductor loading L2. The second branch is connected to the ground element 101 via a feeding point 110. The feeding point 110 may be arranged to be connected to e.g., a receiver, transmitter or transceiver. The third branch comprises a third inductor loading L3. The first inductor loading L1, the second inductor loading L2 and the third inductor loading L3 may comprise a conducting wire shaped as a coil. The shape of the first branch 103, the second branch 105 and the third branch 107 is not limited to the shape illustrated in FIG. 1, but may have any suitable shape. The antenna arrangement 100 further comprises a first grounding pin 113 connected to the first branch 103. Further, a first conductor loading C1 is arranged between the first branch 103 and the second branch 105. The first conductor loading C1 is arranged to control the coupling. The antenna arrangement 100 further comprises a second conductor loading C2 is arranged between the second branch 105 and the third branch 107.

The second branch 105 is connected to the first branch 103 via the first conductor loading C1, where the first conductor loading C1 controls the coupling between the second branch 105 and the first branch 103.

The second branch 105 is connected to the third branch 107 via the second conductor loading C2, where the second conductor loading C2 controls the coupling between the second branch 105 and the third branch 107.

In some embodiments, the antenna arrangement 100 comprises a second grounding pin 115 connected to the third branch 107.

In some embodiments, the antenna arrangement 100 is arranged to transmit and/or receive signals in cellular bands and/or non-cellular bands. In some embodiments, the antenna arrangement 100 is arranged to transmit and/or receive signals in at least one of the following frequency ranges: 700-800 MHz, 824-894 MHz, 880-960 MHz, 1710-1850 MHz, 1820-1990 MHz, 1920-2170 MHz, 2300 MHz, 2400 MHz, 2500-2700 MHz.

In some embodiments, the antenna arrangement 100 comprises a plurality of layers (not shown). In some embodiments, all components of the antenna arrangement 100 is comprised in one layer. In some embodiments, the antenna arrangement 100 comprises a first layer which comprises the ground plane 101 and a second layer which comprises the first inductor loading L1, the second inductor loading L2, the third inductor loading L3, the first conductor loading C1 and the second conductor loading C2.

Figure 2:
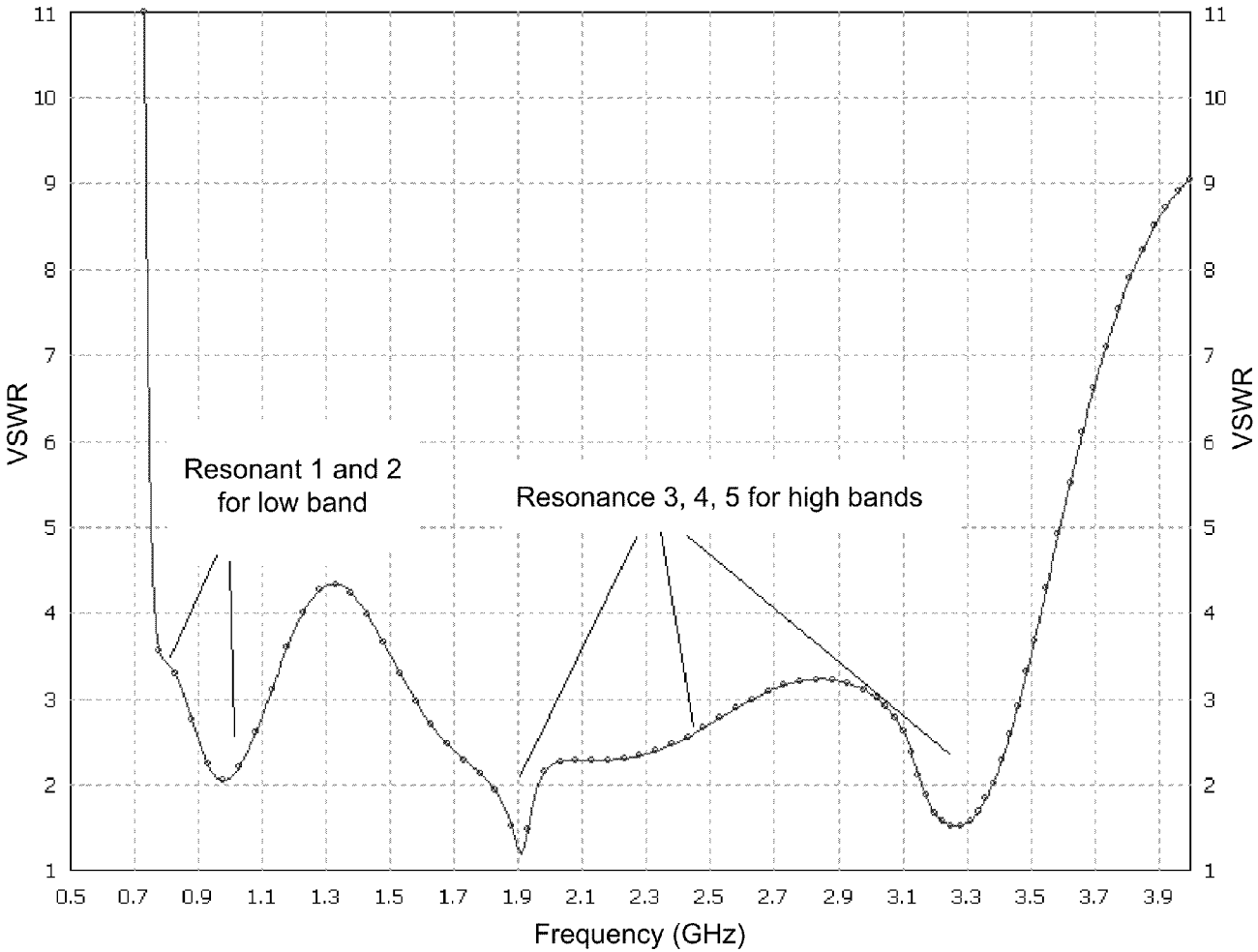
FIG. 2 is a graph illustrating the VSWR of embodiments of the antenna arrangement.

FIG. 2 is a graph illustrating the Voltage Standing Wave Ratio (VSWR) of an embodiment of the antenna arrangement 100 having a multi-band feature that is arranged to cover Long Term Evolution (LTE), High Speed Packet Access (HSPA), Global System for Mobile Communications (GSM), and possibly some non-cellular bands. The VSWR is a scalar measurement and is illustrated on the y-axis. The x-axis represents the frequency measured in gigahertz (GHz). The VSWR is a measure of how efficiently radio-frequency power is transmitted from a power source to the antenna arrangement 100. The antenna arrangement 100 excites a low band chassis mode. Combined with the first branch 103, the arrangement 100 covers 700 to 960 MHz for dual resonance for the low band frequencies. This is seen in the first low band resonance and the second low band resonance in FIG. 2.

FIG. 2 further illustrates that the first conductor loading C1 and the second inductor loading L2 creates a loop which excites the first high band resonance in the antenna arrangement 100, and the second branch 105 create the second high band resonance. The second high band resonance may cover from 1700 to 2700 Mhz bands. The second conductor loading C2 and the third inductor loading L3 creates the third high band resonance in the antenna arrangement 100. The third high band resonance may cover around 3.5 Ghz, which may be new 4G cellular bands.

Figure 3:
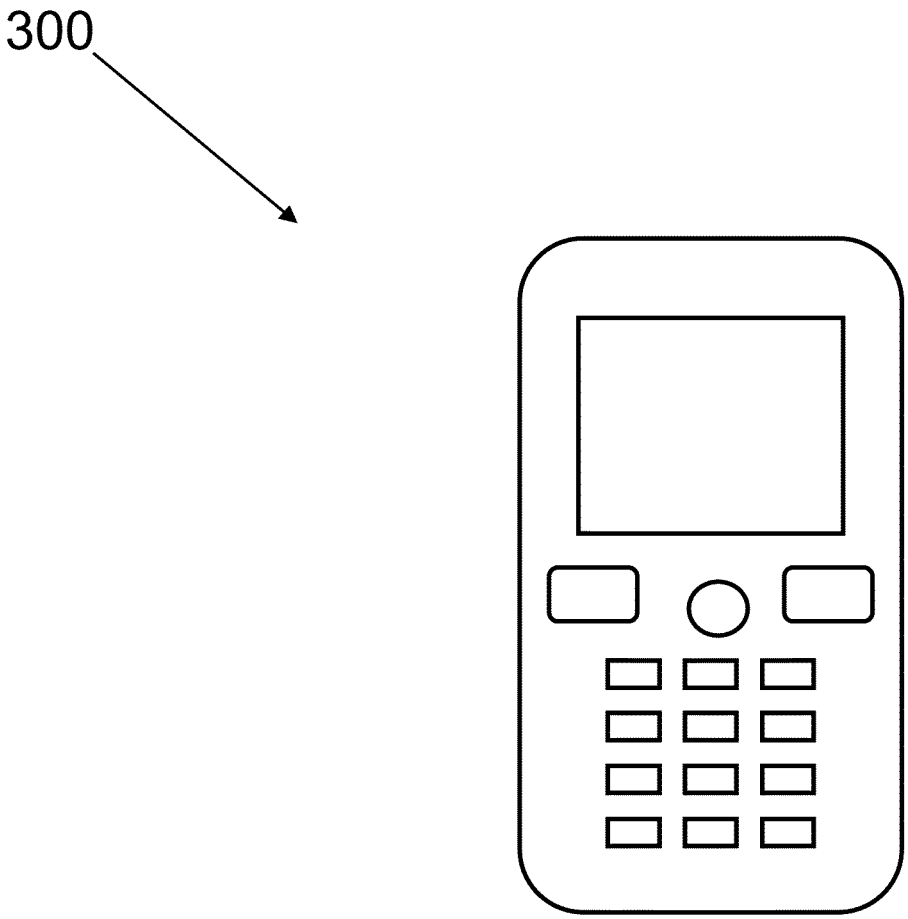
FIG. 3 is a block diagram illustrating embodiments of an electronic device.

FIG. 3 is a schematic block diagram illustrating an electronic device 300 comprising the antenna arrangement 100. The antenna arrangement 100 may be integrated in the electronic device 300 or mounted outside of the electronic device 300, such as e.g., at the bottom of the electronic device 300. In some embodiments, the electronic device 300 is a mobile communication device, such as a mobile telephone or any suitable communication device or computational device with communication capabilities capable to communicate with a base station over a radio channel, for instance but not limited to mobile phone, smart phone, personal digital assistant (PDA), laptop, MP3 player or portable DVD player or similar media content devices, digital camera, or even stationary devices such as a PC. A PC may also be connected via a mobile station as the end station of the broadcasted/multicasted media. The electronic device 300 may also be an embedded communication device in e.g., electronic photo frames, cardiac surveillance equipment, intrusion or other surveillance equipment, weather data monitoring systems, vehicle, car or transport communication equipment, etc.

The embodiments herein are not limited to the above described preferred embodiments. Various alternatives, modifications and equivalents may be used. Therefore, the above embodiments should not be taken as limiting the scope of the embodiments, which is defined by the appending claims.

It should be emphasized that the term "comprises/comprising" when used in this specification is taken to specify the presence of stated features, integers, steps or components, but does not preclude the presence or addition of one or more other features, integers, steps, components or groups thereof. It should also be noted that the words "a" or "an" preceding an element do not exclude the presence of a plurality of such elements.

What is claimed is:

1. An inductor capacitor (LC)-loading antenna arrangement comprising:

a ground element;

a first branch comprising a first inductor loading and a second inductor loading;

a second branch connected to the ground element via a feeding point;

a third branch comprising a third inductor loading; and a first grounding pin connected to the first branch;

wherein a first conductor loading is arranged between the first branch and the second branch and arranged to control coupling between the second branch and the first branch, and wherein the first conductor loading and the first inductor loading are connected in series;

wherein a second conductor loading is arranged between the second branch and the third branch and arranged to control the coupling between the second branch and the third branch, and wherein the second conductor loading and the third inductor loading are connected in series;

wherein the second branch is connected to the first branch via the first conductor loading and the second branch is connected to the third branch via the second conductor loading, wherein the first conductor loading and the second inductor loading create a loop which excites a first high band resonance in the LC-loading antenna arrangement, wherein the second branch creates a second high band resonance in the LC-loading antenna arrangement, and wherein the third inductor loading creates a third high band resonance in the LC-loading antenna arrangement.

2. The LC-loading antenna arrangement according to claim 1, further comprising a second grounding pin connected to the third branch.

3. The LC-loading antenna arrangement according to claim 1, wherein the antenna arrangement is arranged to at least one of transmit or receive signals in at least one of cellular bands or non-cellular bands.

4. The LC-loading antenna arrangement according to claim 1, wherein the antenna arrangement is arranged to at least one of transmit or receive signals in at least one of the following frequency ranges: 700-800 megahertz (MHz), 824-894 MHz, 880-960 MHz, 1710-1850 MHz, 1820-1990 MHz, 1920-2170 MHz, 2300 MHz, 2400 MHz, or 2500-2700 MHz.

5. The LC-loading antenna arrangement according to claim 1, wherein the ground plane is a printed wiring board, a flex film or is printed on a three dimensional plastic carrier.

6. The LC-loading antenna arrangement according to claim 1, wherein the arrangement comprises a plurality of layers, wherein a first layer comprises the ground plane and a second layer comprises the first inductor loading, the second inductor loading, the third inductor loading, the first conductor loading and the second conductor loading.

7. The LC-loading antenna arrangement according to claim 1, wherein the first high band resonance covers from 700 to 960 MHz, wherein the second high band resonance covers from 1700 to 2700 Mhz, and wherein the third high band resonance covers around 3.5 gigahertz (Ghz).

8. An electronic device comprising an antenna arrangement according to claim 1.

9. The electronic device according to claim 8, wherein the antenna arrangement is integrated in the electronic device or mounted outside of the electronic device.

10. The electronic device according to claim 8, wherein the electronic device is a mobile communication device.

* * * * *